US005862715A

United States Patent [19]

Lemire

[11] Patent Number: 5,862,715

[45] Date of Patent: Jan. 26, 1999

[54] TACTILE DETENT KNOB

[75] Inventor: Paul Lemire, Jacksboro, Tenn.

[73] Assignee: Electronic Hardware Corp., Farmingdale, N.Y.

[21] Appl. No.: 574,337

[22] Filed: Dec. 18, 1995

[51] Int. Cl.[6] ..... G05G 1/10; G05G 5/06

[52] U.S. Cl. ..... 74/553; 74/527

[58] Field of Search ..... 74/527, 531, 553; 116/315

[56] References Cited

U.S. PATENT DOCUMENTS

| | | | |
|---|---|---|---|
| 2,840,672 | 6/1958 | Martin . | |
| 3,059,497 | 10/1962 | Eadie . | |
| 3,096,665 | 7/1963 | Cappelle et al. . | |
| 3,198,923 | 8/1965 | Tripp | 200/167 |
| 3,430,515 | 3/1969 | Lawrence, Jr. . | |
| 3,517,570 | 6/1970 | Kolb | 74/527 |
| 3,541,882 | 11/1970 | Testa | 74/553 |
| 3,560,672 | 2/1971 | Ludlum . | |
| 3,662,618 | 5/1972 | Kroll et al. . | |
| 3,767,880 | 10/1973 | Austin . | |
| 3,777,576 | 12/1973 | Miner | 74/10.29 |
| 3,781,499 | 12/1973 | Reichert et al. | 200/166 SD |
| 4,920,818 | 5/1990 | Nagano . | |
| 5,134,898 | 8/1992 | Anderson . | |
| 5,245,886 | 9/1993 | Truesdell et al. . | |

*Primary Examiner*—Vinh T. Luong
*Attorney, Agent, or Firm*—Nolte, Nolte & Hunter

[57] ABSTRACT

A self-contained knob contains a bushing which fits on a control shaft of a control element and extends axially through each of an annular disk and a pedestal. The annular disk slidingly rests upon the pedestal. The disk and pedestal contain between them a pair of concentric, radially separated tracks of spring loaded balls and cavities. The balls momentarily engage the cavities in arc movement as the knob is turned. The pedestal receives at the bottom and is prevented from rotating by a fastener of the control element.

17 Claims, 6 Drawing Sheets

TACTILE DETENT KNOB

BACKGROUND OF THE INVENTION

1. Field of the Invention

This invention pertains to a knob for control elements, more particularly, to a knob which is attached to a rotary shaft of a variable control element to provide a plurality of discrete, different, tactile signals to the operator, including discrete points of resistance to rotation of the shaft.

2. Description of the Prior Art

There are many designs patented for tactile feedback of shaft position provided by mechanisms within control elements including switches. Having the tactile feedback mechanism in a knob, however, simplifies the construction of a control element, reduces inventory and permits selection from a wider choice of control elements on the market in constructing a control system.

U.S. Pat. No. 3,662,618, patented by Kroll et al, May 16, 1972, describes a rotary instrument knob which contains a tactile feedback mechanism.

The knob is attached to the shaft of the instrument by a collet that fits symmetrically about the top of the shaft. A termination socket or bushing, which extends through the panel of the apparatus containing the instrument, has a circular groove at the bottom for attaching a fastener behind the panel. The bushing may also include an indexing finger through the panel or may be fastened to the apparatus by gluing or screwing in order to keep it from turning.

The shaft of the instrument passes upward through the bushing. Mounted on the shaft, above the bushing, is a ring holding balls in equally spaced relation from the shaft which momentarily engage depressions in the top of the bushing, as the ring is rotated by the shaft. Above the ring is a ball retaining disk that is pressed against the balls by a helical compression spring which is permanently concentrical in relation to the shaft. The spring is retained and guided axially, concentrically in relation to the shaft in a circular groove which extends around the shaft.

SUMMARY OF THE INVENTION

It is one object of the invention to provide a knob that attaches to a rotary shaft of a control element.

It is another object that the knob provides a plurality of discrete tactile signals to the operator when the operator rotates the knob.

Another object is that the tactile signals are provided by a detent group within the knob.

Another object is that a series of different tactile signals are provided by the knob as it is turned.

Another object is that the differences in the tactile signals include a sharp change in resistance to rotation, a graduated change in resistance to rotation and various levels of amplitude of the tactile signal.

Another object is that the tactile signals provided by the knob can be easily changed by changing a ring.

Another object is that the knob includes a plurality of detent groups.

Another object is that different ones of the detent groups are on different ones of a pair of parallel annular tracks on the knob.

Another object is that the control element knob engages a retainer element of the control element which prevents rotation of a portion of the knob.

Another object of the invention is that the knob be inexpensive to manufacture and simple to assemble.

Other objects and advantages will become apparent to one reading the ensuing description of the invention.

A tactile detent knob assembly for mounting the shaft of a control element that includes a retainer mounted concentric with the shaft on the control element, includes a bushing that includes a first opening concentric with an axis of the bushing.

The first opening has a diameter that is slightly larger than the diameter of the shaft so that the bushing is held generally concentric with the shaft when it is on the shaft.

A pedestal includes a second opening in the back end of the pedestal which extends axially forward into the pedestal and is of sufficient diametrical size to receive the retainer in the second opening.

The second opening includes a pair of axial walls that are radially spaced apart concentric about the axis so that the walls engage the retainer and prevent substantial rotation between the retainer and the pedestal when the retainer is in the opening.

The back end of the bushing extends axially into the second opening of the pedestal and retaining means in the second opening is connected to the bushing for preventing removal of the bushing from the pedestal. Preferably, the retaining means is a resilient ring that is on the back end of the bushing.

A ring is mounted on the knob assembly at the front end of the pedestal concentric with the axis. The bushing extends axially through the ring between the ring and the axis and also rests against the front side of the ring.

A first spring is radially spaced from the axis. A second spring independent of the first spring is radially spaced from the axis. First detent means biased by the first spring is mounted between the ring and the pedestal and radially spaced from the axis. A second detent means spaced from the first detent means and biased by the second spring is mounted between the ring and the pedestal and radially spaced from the first axis.

The radial distance of the first detent means from the axis is of a different length than the radial distance of the second detent means from the axis.

The first detent means includes a first rider and a first cavity in one of the ring and pedestal. The second detent means includes a second rider and a second cavity in one of the ring and pedestal. The first cavity has a different shape than the second cavity.

One of the cavities includes at least three diverging straight shoulders so that the first rider makes at least three simultaneous independent spaced point-contacts with the shoulders. The shoulders ar preferably of equal length.

DESCRIPTION OF THE PREFERRED EMBODIMENTS

Figure 1:
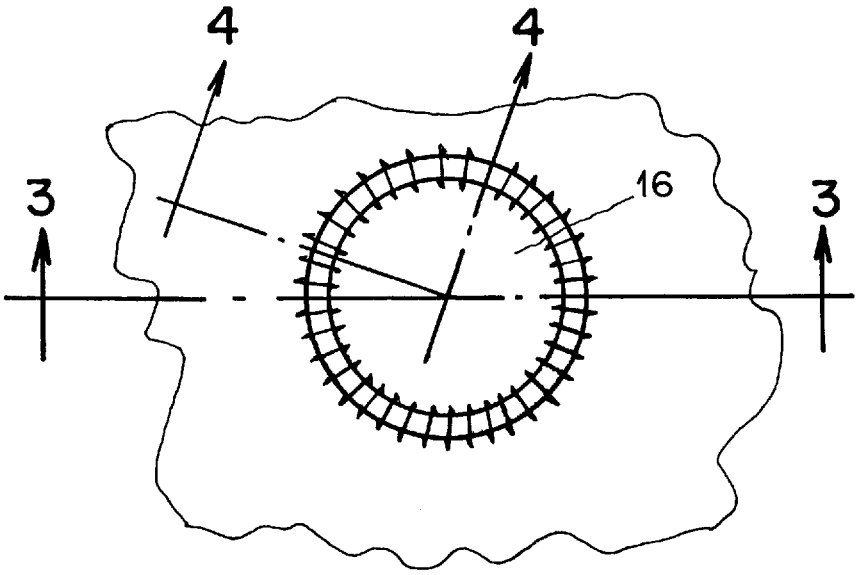
FIG. 1 is a top view of a knob of the present invention mounted on a control element (not shown) which is mounted on a panel.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Figure 2:
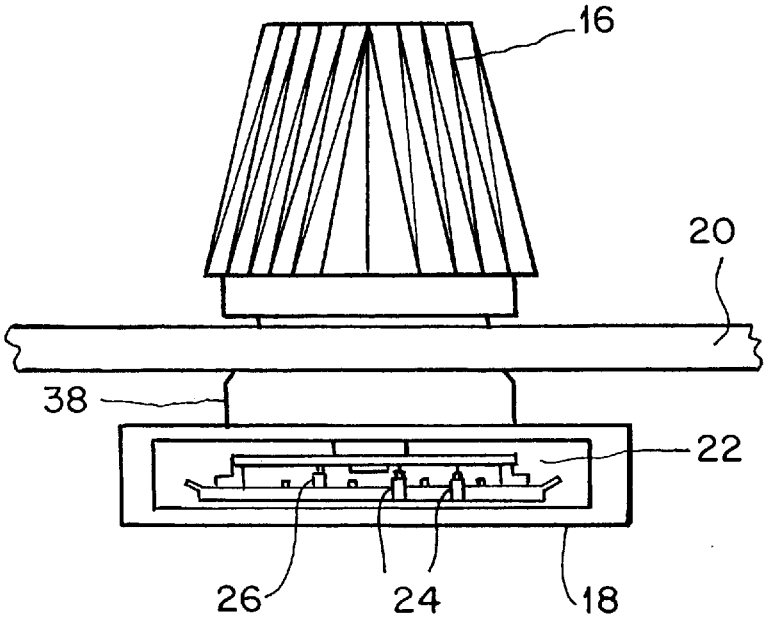
FIG. 2 is a front view of the knob, panel and control element of FIG. 1.
Figure 3:
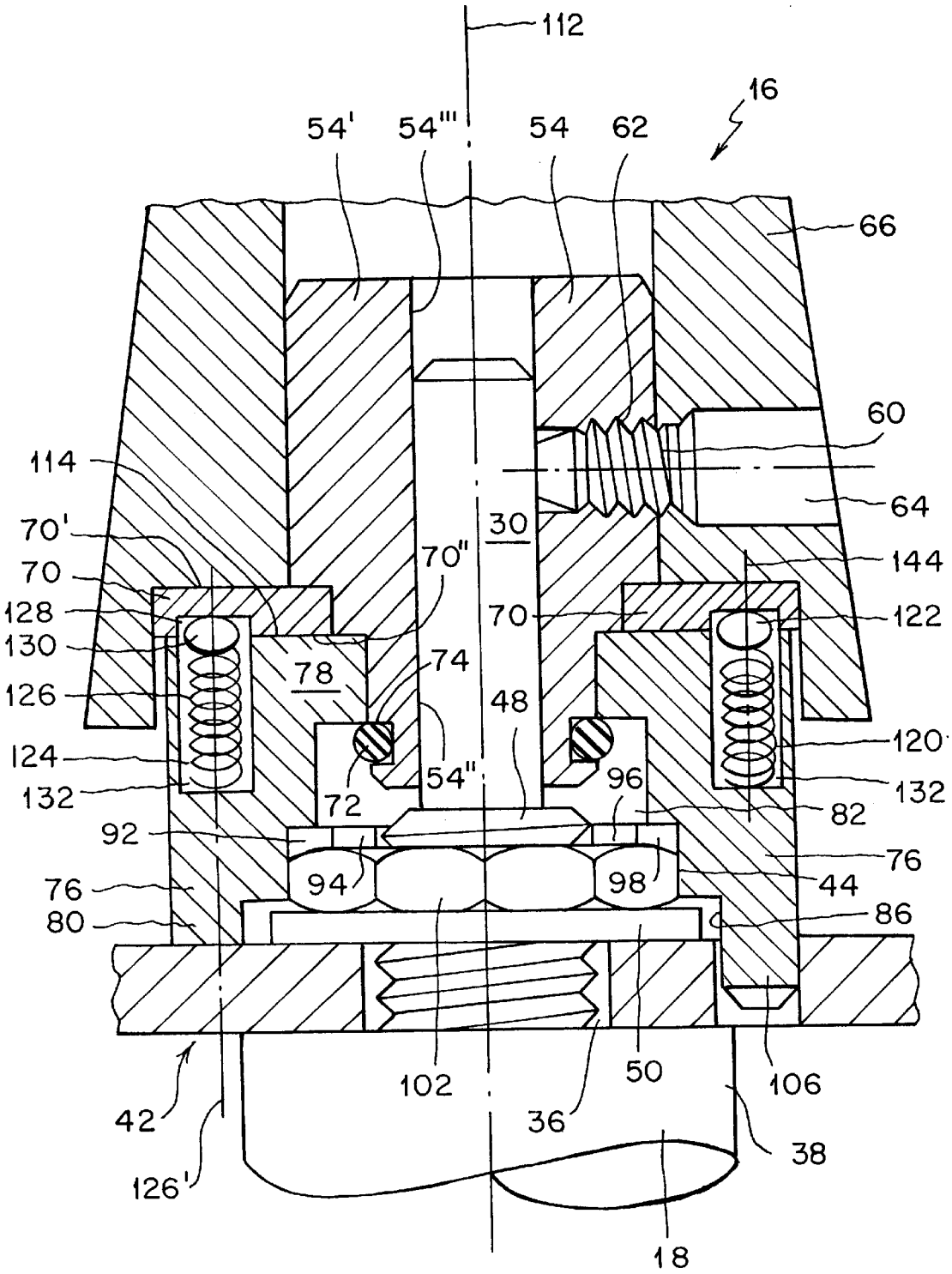
FIG. 3 is a partial cross section view of the assembly of FIGS. 1, taken along 3—3.

Referring to FIGS. 1, 2 and 3, knob 16 is mounted on control element 18 which is mounted on panel 20 of an apparatus. The apparatus is not shown.

Control element 18 is, in this drawing example, a potentiometer 22 having multiple electrical taps 24 and a brush tap 26. The type of control element and circuit is provided herein for example and is not a part of this invention. The potentiometer may be wired so that as knob 16 rotates shaft 30 of the potentiometer, the brush tap provides, in series, a plurality of varying outputs.

As potentiometer 22 provides different outputs at different shaft positions, it is advantageous for an operator to receive different tactile signals as the operator rotates the control element. It is also advantageous that the shaft offers slight resistance against rotating out of each shaft position so that an output is not easily changed by accident.

Even if a control element provides smooth, uniform, linear or logarithmic change in output, it is often advantageous to have tactile feedback simply to mark predetermined portions of the change.

Those features are included among the present invention's advantages.

Figure 5:
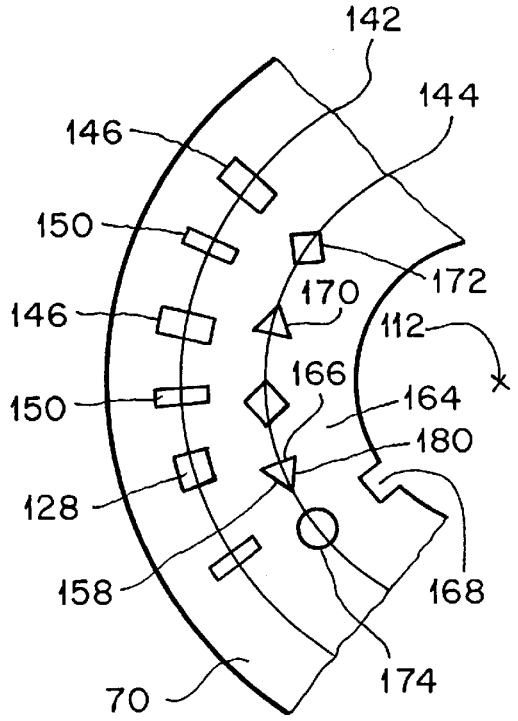
FIG. 5 is a partial cross section view of the knob of FIG. 4, taken along 5—5.
Figure 4:
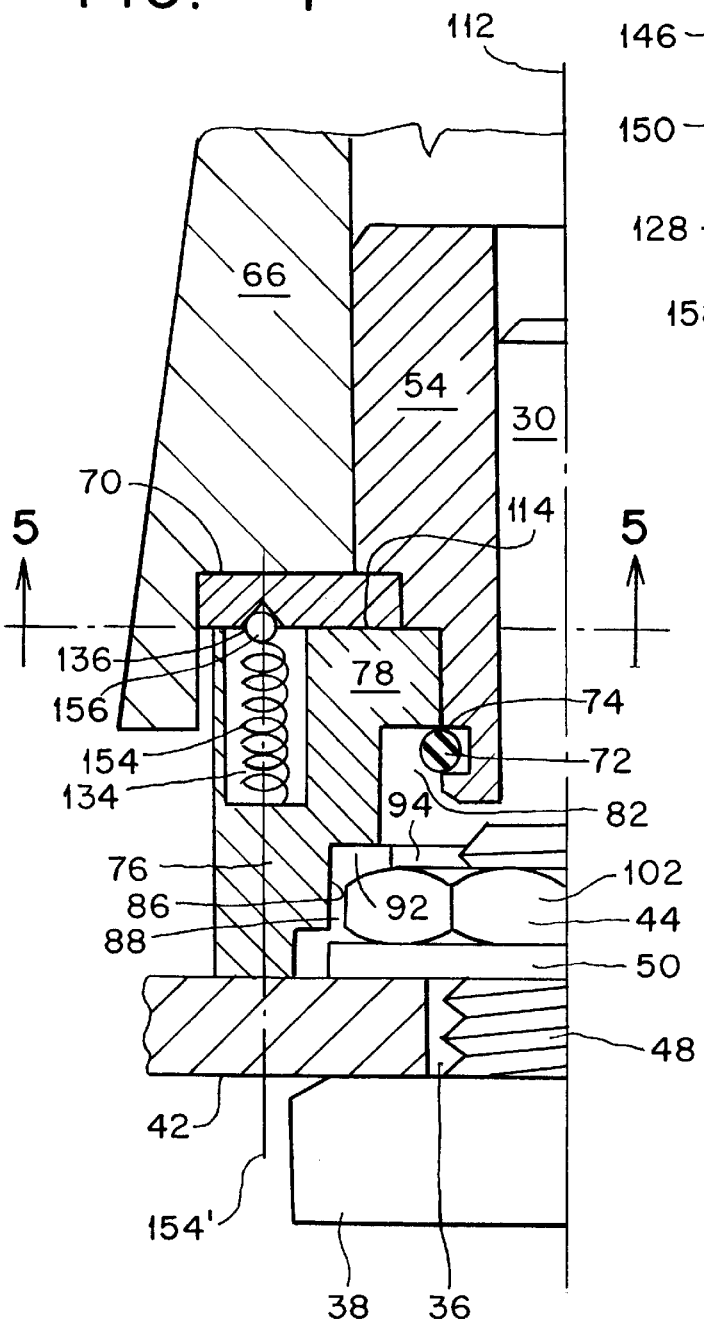
FIG. 4 is a partial cross section view of the assembly of FIG. 1, taken along 4—4.

Referring to FIGS. 3, 4 and 5, housing 38 of control element 18 is drawn against back side 42 of panel 20 by retainer element 44 which is an instrument nut. Threaded shank 48 passes through opening 36 in panel 20. Retainer element 44 is tightened down on threaded shank 48, against instrument washer 50, and coaxial with shaft 30 of control element 18.

Bushing 54, having a front end 54' and a back end 54" and first opening 54", closely fits shaft 30 and is fastened on the shaft by set screw 60 tightened in threads 62. Set screw 60 is accessed for tightening by way of opening 64 in knob shell 66. Preferably, know shell 66 is knurled for better grip by the operator's fingers.

Ring 70 having a front side 70' and a back side 70" is mounted on bushing 54. Bushing 54 passes axially through the ring between the ring and the shaft.

Pedestal 76 is slidably mounted on bushing 54 which passes through forward portion 78 of the pedestal and extends into opening 82 of the pedestal that is at the back end 80 of the pedestal. The bushing, ring and pedestal are held together by resilient ring 72 in circumferential groove 74.

Second opening 82 is of sufficient diametrical size 86 to closely receive the largest diameter portion 88 of retainer element 44. Axial walls 92, 94, 96 and 98 may be provided to prevent rotation between pedestal 76 and retainer 44 by engaging retainer faces 102.

Retainer 44 is prevented from rotating by being fastened against washer 50 that is jammed against panel 20 and further prevented from rotating by finger 106 extending into opening 108 of panel 20 when axial walls 92, 94, 96 and 98 are provided.

Finger 106 may be provided to prevent rotation of pedestal 76 when walls 92, 94, 96 and 98 are not provided to engage the retainer.

Turning knob shell 66 rotates bushing 54 which rotates shaft 58 and ring 70 which rotates about first axis 112 over front wall 114 of the front end 78 of stationary pedestal 76. Notch 118 on ring 70 engages a key (not shown) on bushing 54 to prevent rotational slip between the ring and the bushing.

Ring 70 and bushing 54 include a plurality of detent groups of various types including group 124 (FIG. 3) comprising a first coil spring 126 extending along second axis 126', square cavity 128 and ball shaped rider 130, and group 134 FIG. 4 comprising second coil spring 154, extending along third axis 154' pyramidal cavity 136 and rider 156. Rider 156 is ball shaped.

Knob 16 includes two concentric annular tracks 142 and 144 which are coaxial with axis 112. Detent group 124 is located on larger track 142. Detent group 134 is located on track 144.

Track 142 includes three different kinds of detent groups which provide different tactile signals. Square cavity 128 of detent group 124 provides a smoother interruption than the rectangular cavity 146 of group 148. Square and rectangular cavities 128 and 146 resist rotation of the shaft past them because the ball recesses considerably in each. Narrow rectangular cavity 150 of group 152 offers negligible resistance to rotation, but provides a momentary audible and tactile click as the ball passes over.

The cavities of groups 124, 148 and 152 are each, in turn, engaged by rider 130 which is biased against the cavities by spring 126.

Track 144 includes four more different kinds of detent groups. They each include coil spring 154 and rider 156. Coil spring 154 is stronger than coil spring 126 and rider 156 is of smaller diameter than rider 130, resulting in a more pronounced tactile effect. The springs are in guideways 132 which may be generally similar in shape.

Shoulders 158 and 160 of triangular cavity 164 draw or funnel a clockwise traveling ball toward back stop shoulder 166.

The cavities may be arranged to be engaged alternately or simultaneously by riders 122 and 130 according to tactile effects desired.

In the examples shown in FIGS. 3 and 4, the spring and rider are mounted in a blind hole in the bushing and the cavities are in ring 70.

Figure 6:
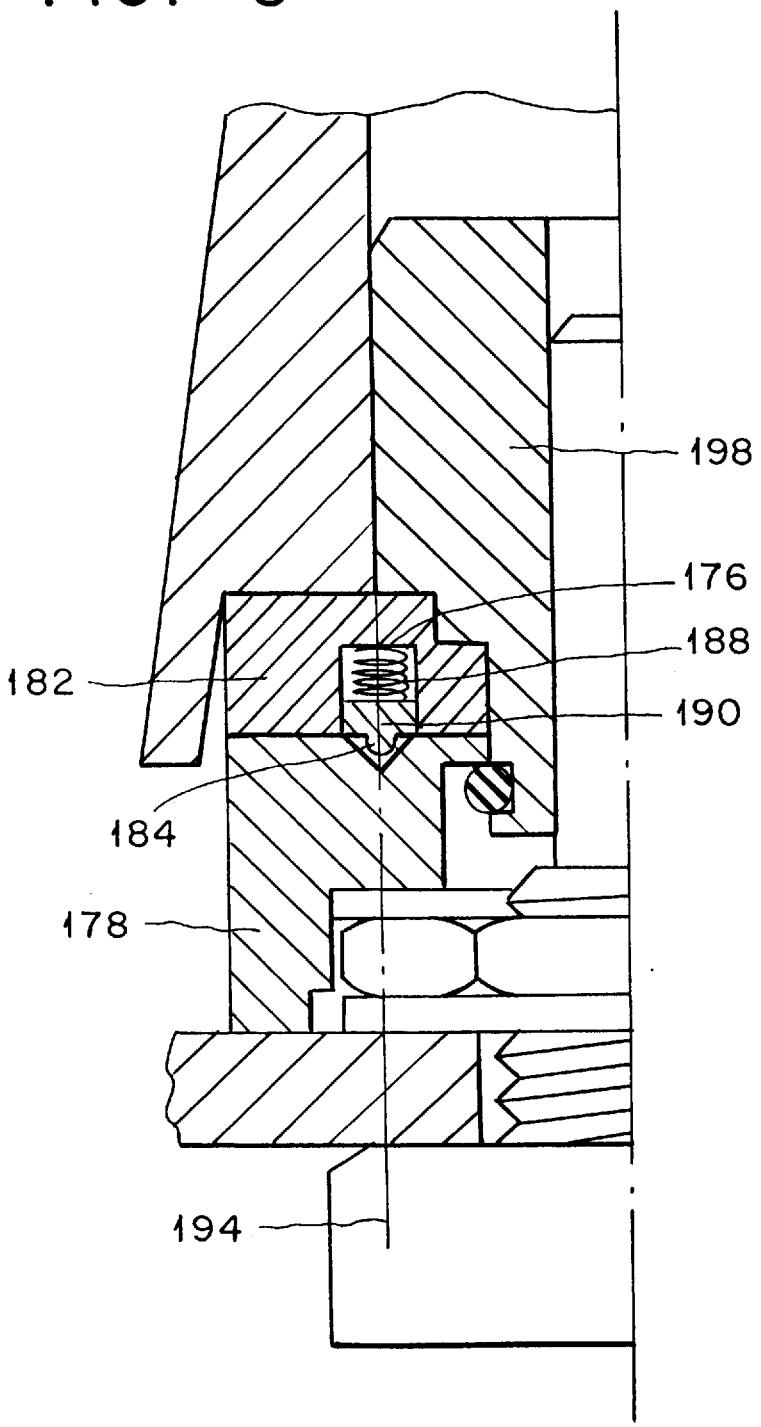
FIG. 6 is a partial cross section view of another knob according to the invention.
Figure 7:
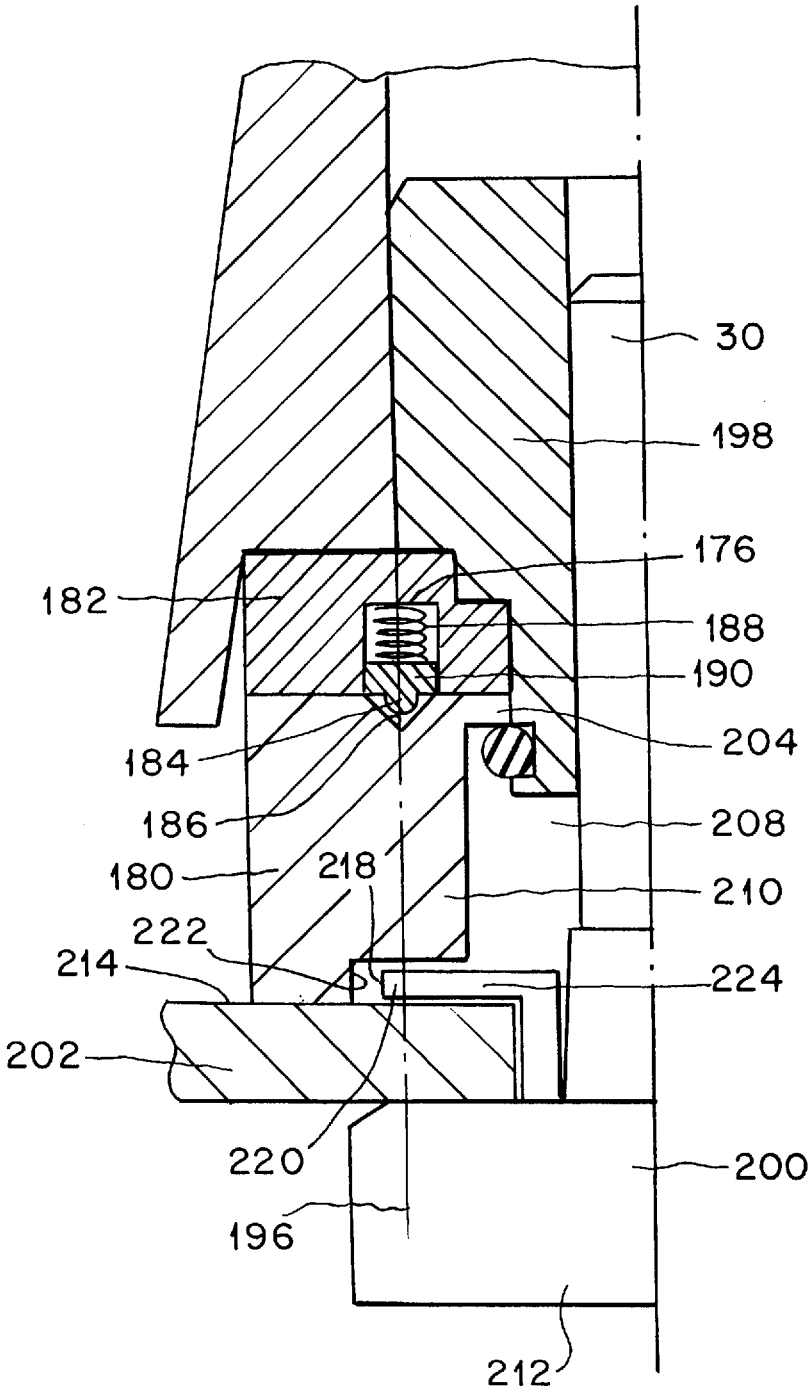
FIG. 7 is a partial cross section view of another knob attached, according to the invention, to a control element.

In FIGS. 6 and 7, the cavities are in pedestals 178 and 180, respectively. Rider 184 is a piston 190 with a spherical end 186. In both FIGS. 6 and 7, riders 184 are mounted in cylindrical blind holes 176 in rings 182 and are biased by springs 188 against pedestals 178 and 180 along annular tracks 194 and 196, respectively.

In FIG. 7, ring 182 is mounted on bushing 198 which passes through ring 182 between the ring and control shaft 168.

Pedestal 180 is slidingly mounted at upper end 204 on bushing 198.

Control element 200 is fastened on panel 202 by retainer element 220. Retainer element 220 is a lug that extends from control element 200, housing 212. It is bent over the front side 214 of panel 202 and clamps housing 212 against the panel.

Opening 208 at the bottom end 210 of pedestal 180 is of sufficient diametrical size to closely receive the largest diameter portion 218 of retainer element 220. Axial wall 222 prevents rotation in a counterclockwise direction between pedestal 180 and retainer element 220 by engaging a lateral face (not shown) of retainer element 220. Opposite lateral face 224 is shown. It is also engaged by pedestal 180 to prevent rotation in the clockwise direction.

It is easy and inexpensive to change the tactile effect or the configuration of a control element knob by replacing a spring, a rider or a set of detent cavities by changing ring or pedestal as applicable.

Figure 8:
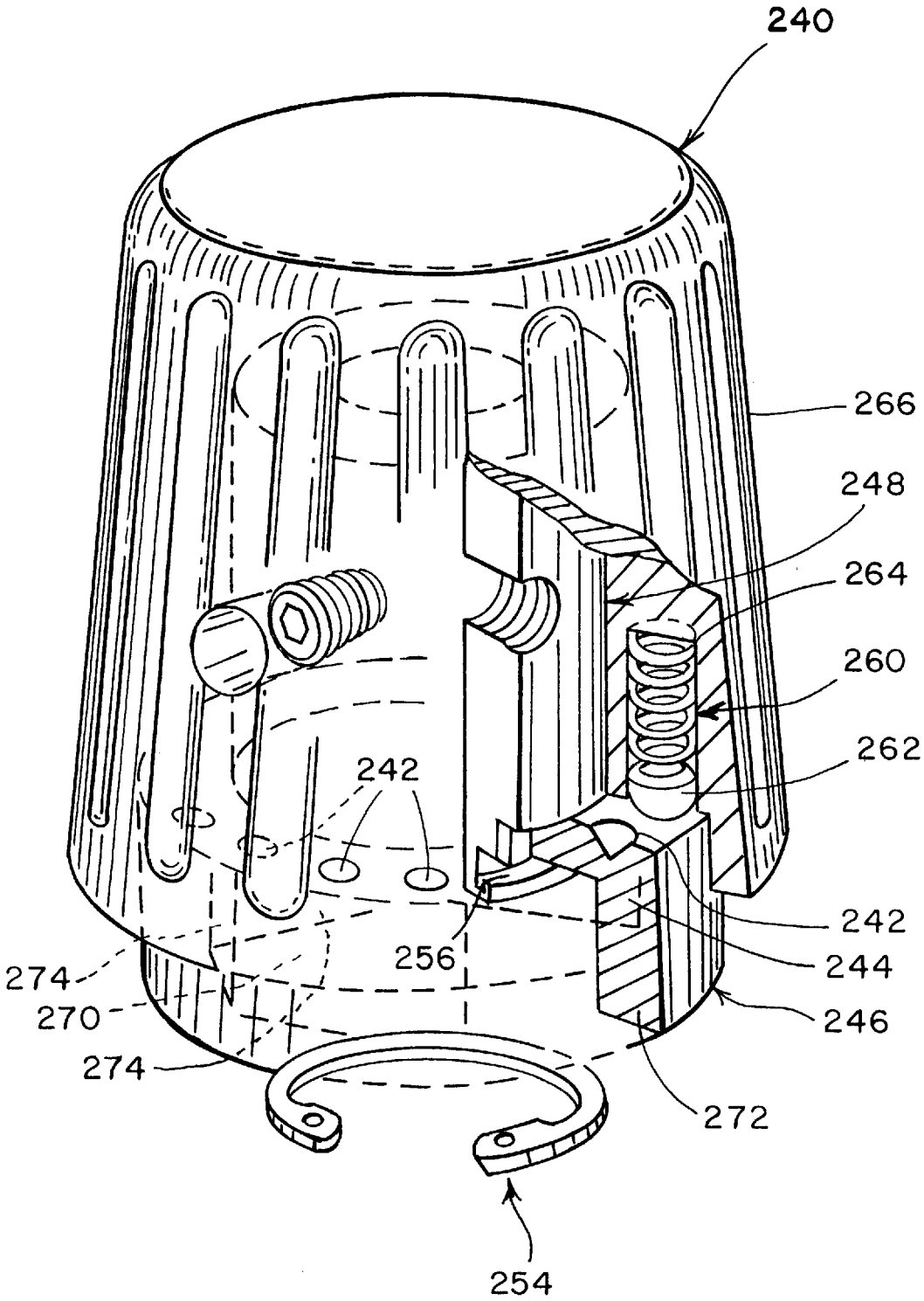
FIG. 8 is another knob according to the invention.

In FIG. 8, a control element knob 240 includes cavities 242 in upper annular portion 244 of pedestal 246. Pedestal 246 is mounted on bushing 248 which passes through the upper portion of pedestal 246. Bushing 248 and pedestal 246 are held together by locking ring 254 in annular groove 256. Spring 260 and rider 262 are held in blind hole 264 in shell 266 of knob 240.

Opening 270 at the bottom end 272 of pedestal 246 is designed to receive a hexagonal retainer element, or instrument nut (not shown) of a control element. Walls 274 of opening 270 are designed to engage the flat walls of the retainer element to prevent rotation between the pedestal and the retainer element.

While the preferred embodiment of the invention has been shown and described, it will be understood that the invention may be embodied otherwise than as herein specifically illustrated or described, and that certain changes in form and arrangement of parts and in the specific manner of practicing the invention may be made without departing from the underlying idea or principles of this invention within the scope of the appended claims.

What is claimed is:

1. A tactile detent knob assembly for use on a shaft (58) of a control element (18) having retaining means for securing the control element to a panel with the shaft of the control element extending through the retaining means on an outer surface of the panel for mounting said assembly thereon, said tactile detent knob comprising:

a bushing (54), having a front end (54'), a back end (54"), and a first axis (112) passing through said front and back ends;

a first opening (54'") in said bushing, concentric with said first axis and having a diameter that is slightly larger than the diameter of the shaft of a control element on which the opening (54'") is to be concentrically mounted;

a pedestal having a forward portion (78) and a back end (80);

said back end of said pedestal comprising a second opening extending axially forward into said pedestal and being of sufficient diametrical size to receive the retaining means of a control element in said second opening, said second opening being concentric about said first axis and having axially extending wall means (92, 94, 96, 98) for engaging retaining means of the control element and for restraining substantial rotation between the retaining means of the control element and said pedestal when the retaining means of the control element is in said second opening;

a ring having a front side and a back side, mounted on said knob assembly at said front end of said pedestal concentric with said first axis;

said bushing extending axially through said ring between said ring and said axis.

2. The assembly of claim 1, further comprising:

said bushing resting against said front side of said ring.

3. The assembly of claim 1, further comprising:

a first spring radially spaced from said first axis;

a second spring independent of said first spring and radially spaced from said first axis;

first detent means biased by said first spring, mounted between said ring and said pedestal and radially spaced from said first axis;

second detent means spaced from said first detent means, biased by said second spring, mounted between said ring and said pedestal and radially spaced from said first axis.

4. The assembly of claim 3, further comprising:

the radial distance of said first detent means from said first axis being a different length than the radial distance of said second detent means from said first axis.

5. The assembly of claim 3, further comprising:

said first detent means comprising a first rider and a first cavity in one of said ring and said pedestal, said second detent means comprising a second rider and a second cavity in one of said ring and said pedestal;

said first cavity having a different shape than said second cavity.

6. The assembly of claim 3, further comprising:

said first detent means comprising a rider and a cavity in one of said pedestal and ring, said rider being biased toward said cavity by said first spring;

said cavity comprising at least three diverging straight shoulders so that said first rider makes at least three simultaneous independent spaced point-contacts with said shoulders.

7. The assembly of claim 6, further comprising:

said straight shoulders being each of equal length.

8. The assembly of claim 7, further comprising:

said bushing extending axially through said ring between said ring and said first axis;

said bushing resting against said front side of said ring.

9. The assembly of claim 1, further comprising:

a first spring;

detent means biased by said first spring, mounted on said pedestal and radially spaced from said first axis;

said detent means comprising a rider and a cavity in one of said pedestal and ring, said rider being biased toward said cavity by said spring.

10. The assembly of claim 9, further comprising:

said back end of said bushing extending axially into said second opening from said front end of said pedestal, said cavity being in said ring, said ring being interchangeable for changing said cavity.

11. The assembly of claim 9, further comprising:

said first spring being a coil spring having a second axis;

said second axis being radially displaced from said first axis.

12. The assembly of claim 9, further comprising:

said second opening comprising a pair of axial walls, radially spaced apart concentric about said first axis so that said walls engage said retainer and prevent substantial rotation between said retainer and said pedestal when said retainer is in said second opening.

13. A tactile detent knob assembly for mounting on a shaft (58) of a controller (18) that is protruding through a panel from the back of the panel through the front of the panel and that includes a retainer mounted at the front of the panel on the controller (18) adjacent to said shaft (58), said tactile detent knob comprising:

a bushing having a front end, a back end, and a first axis passing through the front and back ends of the bushing;

a first opening (58'") in said bushing, concentric with said first axis and having a diameter that is slightly larger than the diameter of the shaft on which the opening (58'") to be concentrically mounted;

a pedestal (76) having a front end and a back end;

said back end of said pedestal comprising a second opening extending axially forward into said pedestal;

said back end of said bushing extending axially into said second opening from said front end of said pedestal;

means (92, 94, 96, 98) between said pedestal and the controller (18) for preventing rotation of said pedestal with respect to the controller (18);

a ring having a front side and a back side, mounted on said knob assembly at said front end of said pedestal concentric with said first axis;

said bushing extending axially through said ring between said ring and said axis.

14. The assembly of claim 13, further comprising:

a first spring radially spaced from said first axis;

first detent means biased by said first spring, mounted between said ring and said pedestal and radially spaced from said first axis.

15. The assembly of claim 14, further comprising:

a second spring independent of said first spring and radially spaced from said first axis;

second detent means spaced from said first detent means, biased by said second spring, mounted between said ring and said pedestal and radially spaced from said first axis.

16. The assembly of claim 15, further comprising:

the radial distance of said first detent means from said first axis being a different length then the radial distance of said second detent means from said first axis.

17. The assembly of claim 13 wherein said preventing means comprises said pedestal having a portion extending into said panel, preventing rotation of said pedestal with respect to the controller.

* * * * *